US009589463B2

(12) United States Patent
Witte et al.

(10) Patent No.: US 9,589,463 B2
(45) Date of Patent: Mar. 7, 2017

(54) METHODS AND SYSTEMS FOR DETERMINING INFORMATION RELATING TO THE OPERATION OF TRAFFIC CONTROL SIGNALS

(71) Applicant: TomTom Development Germany GmbH, Leipzig (DE)

(72) Inventors: Nikolaus Witte, Berlin (DE); Rene Beier, Berlin (DE)

(73) Assignee: TomTom Development Germany GmbH, Leipzig (DE)

( * ) Notice: Subject to any disclaimer, the term of this patent is extended or adjusted under 35 U.S.C. 154(b) by 65 days.

(21) Appl. No.: 14/354,145

(22) PCT Filed: Oct. 25, 2012

(86) PCT No.: PCT/EP2012/071145
§ 371 (c)(1),
(2) Date: Apr. 25, 2014

(87) PCT Pub. No.: WO2013/060774
PCT Pub. Date: May 2, 2013

(65) Prior Publication Data

US 2014/0266798 A1 Sep. 18, 2014

(30) Foreign Application Priority Data

Oct. 25, 2011 (GB) ..... 1118432.2

(51) Int. Cl.
*G08G 1/095* (2006.01)
*G08G 1/07* (2006.01)
(Continued)

(52) U.S. Cl.
CPC ..... *G08G 1/07* (2013.01); *G08G 1/0112* (2013.01); *G08G 1/0145* (2013.01); *G08G 1/096827* (2013.01)

(58) Field of Classification Search
USPC ..... 340/932
See application file for complete search history.

(56) References Cited

U.S. PATENT DOCUMENTS 8,306,725 B2 * 11/2012 Son ..... B60W 50/14 123/361
8,996,286 B1 * 3/2015 Klein ..... G01C 21/3415 701/117
(Continued)

FOREIGN PATENT DOCUMENTS

CN 101673466 A 3/2010
CN 101739825 A 6/2010
(Continued)

OTHER PUBLICATIONS

Koukoumidis et al: SignalGuru: Leveraging Mobile Phones for Collaborative Traffic Signal Schedule Advisory, MobiSys 2011.
(Continued)

*Primary Examiner* — Travis Hunnings

(57) ABSTRACT

A method of obtaining data relating to the timing of a transition between phases of a traffic control signal. The method involves obtaining live probe data relating to the travel of vehicles in the region of the traffic control signal, and using the data to determine times at which a given transition of the signal has occurred. This is carried out by consideration of the distance from the traffic signal at which a vehicle waits when stopped at the signal, and a time of passing the signal, as determined using the probe data. Different transition time pairs are analyzed to obtain time differences between the transition times. A cycle time which best fits the time difference data is determined, and used with the transition time data to predict future transition times of the traffic control signal.

15 Claims, 6 Drawing Sheets

(51) Int. Cl.
*G08G 1/01* (2006.01)
*G08G 1/0968* (2006.01)

(56) References Cited

U.S. PATENT DOCUMENTS

2004/0083037 A1* 4/2004 Yamane ..... G08G 1/08 701/1
2010/0043404 A1* 2/2010 Hebbale ..... F01N 9/00 60/286
2010/0070128 A1* 3/2010 Johnson ..... G08G 1/096783 701/31.4
2010/0088002 A1* 4/2010 Welte ..... G01C 21/3469 701/99
2010/0235038 A1* 9/2010 Itoh ..... B60R 16/0236 701/31.4
2013/0076538 A1* 3/2013 Uno ..... G08G 1/096716 340/905
2013/0297124 A1* 11/2013 Be ..... G06F 17/00 701/22

FOREIGN PATENT DOCUMENTS

CN 101842819 A 9/2010
JP 2008197725 A 8/2008
JP 2009116508 A 5/2009
WO 2007061734 A2 5/2007
WO 2011157288 A1 12/2011
WO 2012034582 A1 3/2012

OTHER PUBLICATIONS

XP032023444—Thorsten Neumann: 11 DPAnalyzer: An example of combining common and innovative methods for probe-vehicle-based urban traffic monitoring Intelligent Transportation Systems ( ITSC), 2011 14th International IEEE Conference on, IEEE ,Oct. 5, 2011 (Oct. 5, 2011), pp. 396-401.
XP002690284—N.Garber, L. Hoel: "Traffic and Highway Engineering, 2nd Edition",Dec. 31, 1996 (Dec. 31, 1996), PWS Publishing , California, USA, ISBN: 053436537X, pp. 312-316, Equation (8.18);p. 312.
XP002690285—M. Papageorgiu: "Concise Encyclopedia of Traffic & Transportation Systems, 2nd Edition", Dec. 31, 1999 (Dec. 31, 1999), Elsevier Science Ltd , The Netherlands, ISBN: 0080362036, pp. 404-405, figures 4,5.
XP027906101—Dotoli M et al: "A signal ti ming plan formulation for urban traffic control", Control Engineering Practice , Pergamon Press, Oxford, GB, vol. 14, No. 11, Nov. 1, 2006 (Nov. 1, 2006), pp. 1297-1311, ISSN : 0967-0661 [retrieved on Nov. 1, 2006] figure 2.
International Search Report issued Feb. 7, 2013 for International Application No. PCT/EP2012/071145.

* cited by examiner

| | M1 | M2 | M3 | M4 |
|---|---|---|---|---|
| M1 | 0 | 393 +/-6.5 | 1108 +/-8.5 | 1676 +/-5.5 |
| M2 | | 0 | 715 +/-6 | 1283 +/-3 |
| M3 | | | 0 | 568 +/-5 |
| M4 | | | | 0 |

| | Time [hours] | Cycle time C1 | Cycle time C2 | Cycle time C3 &C4 |
|---|---|---|---|---|
| Weekday | 0-5 | 90s | 90s | 90s |
| | 5-10 | ? | ? | ? |
| | 10-14 | 90s | 90s | 90s |
| | 14-20 | 100s | 100s | 100s |
| | 20-21 | 90s (Thu:100s) | 90s (Thu:100s) | 90s (Thu:100s) |
| | 21-24 | 90s | 90s | 90s |
| Saturday | 0-5 | 90s | 90s | 90s |
| | 5-10 | ? | 90s | 90s |
| | 10-14 | 90s | 90s | 90s |
| | 14-20 | 100s | 90s | 90s |
| | 20-24 | 90s | 90s | 90s |
| Sunday | 0-15 | 90s | 90s | 90s |
| | 15-20 | ? | ? | ? |
| | 20-24 | 90s | 90s | 90s |

Figure 7

METHODS AND SYSTEMS FOR DETERMINING INFORMATION RELATING TO THE OPERATION OF TRAFFIC CONTROL SIGNALS

CROSS-REFERENCES TO RELATED APPLICATIONS

This application is the National Stage of International Application No. PCT/EP2012/071145, filed Oct. 25, 2012 and designating the United States. The application claims priority from United Kingdom Patent Application No. 1118432.2, filed Oct. 25, 2011. The entire content of both these applications is incorporated herein by reference.

FIELD OF THE INVENTION

The present invention relates to methods and systems for determining information relating to the operation of traffic control signals, and in particular, although not exclusively, to methods for determining information relating to transition times of a traffic control signal, and to predicting future transition times. In preferred embodiments at least, the present invention also extends to methods for determining traffic control signal cycle times.

BACKGROUND OF THE INVENTION

Information relating to the operation of traffic control signals may be useful in various contexts. Methods and systems have previously been proposed in which information or recommendations are provided to drivers based upon information relating to the operation of traffic control signals, e.g. traffic lights. In some methods, information may be provided to drivers regarding the state of upcoming traffic control signals, e.g. along a route being navigated. The information may be used to provide a speed recommendation to drivers. For example, a driver may be advised as to an appropriate speed of travel to enable them to arrive at a traffic control signal in order to coincide with a green phase of the signal, i.e. to ride a "green wave" through a series of traffic control signals. Information about the operation of traffic control signals may be used to advise as to appropriate speeds of travel to enable a driver to travel through a region containing one or more sets of traffic control signals in a more efficient manner, in terms of travel time and/or fuel usage. Knowledge of traffic control signal operation is also useful in determining more accurate travel times, e.g. by navigation devices, or for infrastructure planning, etc.

Information about the operation of traffic control signals has previously often relied upon on traffic control signal operation data obtained from third party sources (e.g. governmental traffic sources). Such data may often be based upon data collected from fixed traffic sensors in the vicinity of traffic control signals. Techniques of this type offer limited flexibility in terms of the data available and the traffic control signals for which data is provided, and are relatively expensive to implement, requiring the appropriate fixed infrastructure to be in place.

The Applicant has realised that there is a need for improved methods and systems for obtaining information relating to the operation of traffic control signals.

SUMMARY OF THE INVENTION

In accordance with a first aspect of the invention there is provided a method for determining information relating to the operation of a traffic control signal, the method comprising:

using positional data relating to the movement of one or more device with respect to time along a path controlled by the traffic control signal to determine data indicative of one or more times at which a transition between phases of the traffic control signal has occurred; and using the determined transition time data to predict one or more times at which a future transition between phases of the traffic control signal is expected to occur.

In accordance with the invention, therefore, positional data relating to the movement of one or more devices, and preferably a plurality of devices, with respect to time along a path controlled by the traffic control signal is used to determine data indicative of at least one time at which a transition between phases of the traffic signal has occurred (a "transition time"). This positional data, sometimes known as "probe data", is typically data relating to the movement of device(s) associated with respective vehicles. By using such positional data to obtain information regarding a transition time of the traffic control signal, the need to rely upon a fixed infrastructure to obtain the data is avoided. The present invention thus allows transition time information to be obtained more flexibly, and in relation to larger numbers of traffic control signals, without needing to modify the traffic control signals, or install sensors etc to collect the data. References to "positional data" herein should be understood to refer to the positional data that relates to the movement of one or more devices with respect to time. In accordance with the invention, the determined transition time data is used to predict a future transition time or times of the traffic control signal.

It will be appreciated that the use of positional data relating to the movement of one or more devices with respect to time may result in more accurate determination of the operation of the traffic control signal, as it reflects the actual movement of devices, e.g. vehicles following a path that is subject to control by the traffic control signal. Thus, in contrast to information obtained from third parties or other sources, relating to the expected operation of the traffic control signal, the transition time information obtained in accordance with the present invention is based on the actual operation of the traffic control signal, as determined indirectly by consideration of the impact of the traffic control signal upon the movement of device(s) in the vicinity of the signal. Thus, the information obtained is not subject to errors which might arise by virtue of, for example, inaccuracy in the clocks controlling the timing of the phasing or cycle of a traffic control signal.

The Applicant has found that data relating to the movement of a device or devices along a path controlled by a traffic control signal may be used to infer information about the operation of the traffic control signal, including a transition time or times thereof. As will be described in more detail below, stop and go phases of the traffic control signal will result in corresponding patterns in the speed of flow of traffic along the path approaching and passing the location of the traffic control signal, which may be analysed to provide information about the operation of the traffic control signal, and allow a future transition time to be predicted.

The present invention also extends to a system for determining information relating to the operation of a traffic control signal. Thus, in accordance with a further aspect the present invention there is provided a system, which may be a server, for determining information relating to the operation of a traffic control signal, the system comprising:

means for using positional data relating to the movement of one or more device with respect to time along a path controlled by the traffic control signal to determine transition time data indicative of one or more time at which a transition between phases of the traffic control signal occurred; and means for using the determined transition time data to predict one or more time at which a future transition between phases of the traffic control signal is expected to occur.

The present invention in this further aspect may include any or all of the features described in relation to the first aspect of the invention, and vice versa, to the extent that they are not mutually inconsistent. Thus, if not explicitly stated herein, the system of the present invention may comprise means for carrying out any of the steps of the method described.

The means for carrying out any of the steps of the method may comprise a set of one or more processors configured, e.g. programmed, for doing so. A given step may be carried out using the same or a different set of processors to any other step. Any given step may be carried out using a combination of sets of processors. The system may further comprise data storage means, such as computer memory, for storing, for example, the data indicative of the determined one or more transition time and/or one or more predicted transition time.

The methods of the present invention are, in preferred embodiments, implemented by a server. Thus, in embodiments, the system of the present invention comprises a server comprising the means for carrying out the various steps described, and the method steps described herein are carried out by a server.

In accordance with the invention in any of its aspects or embodiments, the traffic control signal is a traffic control signal which may act to control different vehicle movements along a path comprising at least a portion of one or more navigable segments, e.g. at an intersection. The traffic control signal may be any automated traffic control signal. Preferably the traffic control signal is a traffic light. The traffic control signal is preferably located at an intersection. The intersection is an intersection where there are competing movements of traffic. The intersection may be a roundabout, crossing or any type of intersection. The traffic control signal may be one of a plurality of traffic control signals located at the intersection.

As used herein, a transition time of the traffic control signal refers to a time at which a transition between different phases of the traffic control signal occurs. As will be appreciated, the transition for which transition time data is determined based on the positional data is a transition that has already occurred, i.e. it is a past transition. The one or more past transition times are then used to obtain data indicative of a predicted future transition time or times.

The traffic control signal operates in accordance with a predetermined repeated cycle comprising different phases. Thus the phases between which the transition occurs are phases of a cycle of the traffic control signal. A given cycle of the traffic control signal is a cycle containing a complete set of the different phases of the traffic control signal through which the signal transitions. The traffic control signal transitions between the different phases in accordance with an automated traffic control signal cycle having a "cycle length". The cycle length is thus defined by a complete sequence of phases of the traffic control signal. The sequence of phases of the traffic control signal will be repeated in subsequent cycles. In practice, the cycle length of a given traffic control signal may be time dependent. For example, the cycle length may vary over the course of a day. The traffic control signal may also be controlled to operate in accordance with one or more different cycle lengths in different time periods, e.g. within a 24 hour period, on different days of the week (such as the weekend versus weekdays), at peak times and non peak times on particular days, etc.

In accordance with the invention, the method involves determining information or data relating to one or more transition times of the traffic control signal and using the data to predict a future transition time or times. The determined transition time information may be an estimation of the or each transition time. The determined transition time(s) and/or the predicted transition time(s) may be based upon certain assumptions, e.g. in relation to the cycle time. For example, it may be assumed that the cycle time is constant over a given time period, e.g. an hour, or a certain number of hours. In some embodiments the cycle time is taken to be constant for corresponding time slots at the same time of day and on the same day of the week. Another assumption that may be made is that the phase pattern and duration within a given cycle is constant at least over a given time period. For example, the effects of an on demand pedestrian crossing phase being activated may be ignored for the purposes of determining transition time and/or predicting future transition time(s). The transition time data, as discussed in more detail below, is preferably determined based on "live" data, and thus the effects of any change in cycle time when determining past transition time data may be minimised.

In preferred embodiments in which the traffic control signal is a traffic light, the phases include red and green phases of the traffic light, and the determined transition time data is indicative of a time at which a transition between the red and green phases occurs, most preferably at which a transition from a red phase to a green phase of the signal occurs. Of course, the traffic control signal cycle may, and typically does, comprise one or more additional phases. In embodiments the traffic control signal cycle further comprises a yellow phase. While the transition in respect of which a transition time is determined using the positional data in accordance with the invention may be a transition between any ones of the different phases of the traffic control signal, preferably the transition is a transition between the red and green phases, and most preferably from the red to the green phases. Such transitions can be more readily determined on the basis of positional data as described herein. Of course, the traffic control signal may provide an indication of phases other than in terms of a colour. For example, the phases may be indicated by one or more symbols. Such arrangements may be used in connection with traffic control signals for controlling movements of public transport vehicles, e.g. trams, trains, etc. Accordingly, in general, the phases for which transition time data is determined occurs may be stop and go phases for the path that is being controlled.

Where data indicative of a plurality of transition times is obtained using the positional data, i.e. indicative of a plurality of different times at which a transition of the signal between phases has occurred, preferably the times are in respect of corresponding transitions of the signal, i.e. a given transition between the same phases. Similarly, preferably the or each future transition in respect of which a prediction is made is a corresponding transition to that in respect of which transition time data is determined. This may provide a simpler system, and facilitate prediction of future transition times based on the determined transition time data.

The method may extend to the step of obtaining, e.g. receiving, the positional data. The method may thus comprise obtaining positional data relating to the movement of a plurality of devices in a geographic region including a location of the traffic control signal, and filtering the positional data to obtain positional data relating to the movement of one or more devices along the path subject to the control of the traffic control signal. This may be done by reference to a known location of the traffic control signal. The geographic region may be of any extent. The region may be a region of a digital map.

A digital map as referred to herein comprises a plurality of nodes connected by a plurality of segments, the segments being indicative of navigable segments. While exemplary embodiments refer to road segments of a road network, it will be appreciated that the invention is applicable to any form of navigable segment, including segments of a path, river, canal, cycle path, tow path, railway line, or the like. For ease of reference these are commonly referred to as a road segment of a road network.

In some arrangements the step of receiving the data may comprise accessing the data, i.e. the data being previously received and stored. For live positional data, it will be appreciated that the data may be stored shortly before being used, so that it may still be considered to be live data. In arrangements in which the step of receiving the data involves receiving the data from the devices, it is envisaged that the method may further comprise storing the received positional data before proceeding to carry out the other steps of the present invention, and optionally filtering the data. The step of receiving the positional data need not take place at the same time or place as the other step or steps of the method.

The positional data used in accordance with the invention is collected from one or more, and preferably multiple devices, and relates to the movement of the devices with respect to time. Thus, the devices are mobile devices. It will be appreciated that at least some of the positional data is associated with temporal data, e.g. a timestamp. For the purposes of the present invention, however, it is not necessary that all positional data is associated with temporal data, provided that it may be used to provide the information relating to the traffic control signal in accordance with the present invention. However, in preferred embodiments all positional data is associated with temporal data, e.g. a timestamp.

The positional data relates to the movement of the or each device with respect to time, and may be used to provide a positional "trace" of the path taken by the device. As mentioned above, the data may be received from the device(s) or may first be stored. The devices may be any mobile devices that are capable of providing the positional data and sufficient associated timing data for the purposes of the present invention. The device may be any device having position determining capability. For example, the device may comprise means for accessing and receiving information from WiFi access points or cellular communication networks, such as a GSM device, and using this information to determine its location. In preferred embodiments, however, the device comprises a global navigation satellite systems (GNSS) receiver, such as a GPS receiver, for receiving satellite signals indication the position of the receiver at a particular point in time, and which preferably receives updated position information at regular intervals. Such devices may include navigation devices, mobile telecommunications devices with positioning capability, position sensors, etc. The device may be associated with a vehicle. In these embodiments the position of the device will correspond to the position of the vehicle. The device may be integrated with the vehicle, or may be a separate device associated with the vehicle such as a portable navigation apparatus. Of course, the positional data may be obtained from a combination of different devices, or a single type of device.

The positional data obtained from the plurality of devices is commonly known as "probe data". The data obtained from devices associated with vehicles may be referred to as vehicle probe data. References to "probe data" herein should therefore be understood as being interchangeable with the term "positional data", and the positional data may be referred to as probe data for brevity herein.

The method of the present invention involves using positional data relating to the movement of one or more devices with respect to time along a path controlled by the traffic control signal to determine data indicative of one or more transition time for the signal. In preferred embodiments data relating to the movement of a plurality of devices is used. The data may be in the form of a respective trace of position against time for the or each device. Of course, in preferred embodiments where data indicative of a plurality of times at which a transition has occurred is determined, positional data from a plurality of devices will be used to determine the plurality of transition times, although the determination of each given transition time may be based upon data from one or more device.

The method of the present invention preferably involves using "live" positional data relating to the movement of one or more devices with respect to time along a path subject to control by the traffic control signal to determine information relating to the one or more transition times of the traffic light. Live data may be thought of as data which is relatively current and provides an indication of the relatively current operation of the traffic control signal. The live data may typically relate to the conditions on the path controlled by the traffic control signal within the last 30 minutes, 15 minutes, 10 minutes or 5 minutes. By using live positional data in determining the transition time of the traffic control signal, it may be assumed that the information determined is currently applicable, and may be applicable in the future, at least in the shorter term, e.g. until there is a change in cycle time. Thus, the information may be used to provide reliable predictions as to future transition times of the traffic control signal. The use of live data also enables assumptions to be made regarding cycle time and/or phase duration and/or phase transition pattern within a cycle, which more accurately reflect actual conditions. For example, if the live data indicates a particular transition time, it may be assumed more readily that this transition time may be applicable in the short term future, i.e. that cycle time and/or phase composition is to remain constant. By using live positional data, the present invention provides the ability to determine transition time information even where the traffic control signal may not operate in accordance with a predetermined timing, e.g. where the signal is response at least in part to current traffic conditions. The age of the live data may be chosen as appropriate, and may take into account, e.g. a period over which cycle time of the signal may be assumed to be constant, etc.

In some preferred embodiments "historical" positional data may be used in combination with "live" data. In this context the word "historical" should be considered to indicate data that is not live, that is data that is not directly reflective of conditions, i.e. on the path controlled by the traffic control signal at the present time or in the recent past (perhaps within roughly the last five, ten, fifteen or thirty minutes). Historical positional data can also be referred to as aggregated positional data, since it will typically comprise positional data from a plurality of different mobile devices collected over an extended period of time, such as a number of weeks or months. Historical positional data is therefore useful in analysing the repeating patterns in the behaviour of vehicles on portions of the road network over long time periods (such as the average speed of travel along a road at various different times of the day); live positional data meanwhile, as mention above, is useful in detecting more transient behaviour of vehicles (such as identifying the occurrence of a traffic jam, or similar event effecting traffic flow, on a road).

The method of the present invention, as discussed above, involves the step of using the positional data relating to the movement of one or more devices with respect to time along at least a portion of the path controlled by the traffic control signal that approach a location of the traffic control signal to determine the data indicative of a given transition time. The method may involve using positional data relating to the movement of one or more devices along a portion of the path passing through and, optionally beyond a location of the traffic control signal. The positional data is preferably positional data relating to the movement of one or more devices following a particular path subject to control by the traffic control signal, e.g. through an intersection at which the traffic control signal is located. For example, a traffic control signal may include phases controlling a straight ahead path and a right turn path, e.g. corresponding to a main path and a filter lane path through the signal, and by selecting positional data relating to a particular path past the traffic control signal, more accurate conclusions may be drawn, as the positional data for each device considered will relate to the same mode of operation of the signal. In some embodiments the method comprises filtering positional data relating to the movement of a plurality of devices with respect to time in a given geographic region to obtain data relating to the movement of one or more, and preferably a plurality of, devices following the same particular path subject to control by the traffic control signal.

It will be appreciated that the relevant positional data relating to the movement of a device or devices along a path subject to control by a traffic control signal may be obtained by consideration of the location of the traffic control signal. The location of a traffic control signal is known, e.g. and is stored in digital map data. The method may comprise using digital map data indicative of a location of the traffic control signal to select the positional data relating to one or more devices moving along a path subject to control by the traffic control signal, e.g. from positional data relating to the movement of a plurality of devices in a geographic region including the location of the traffic control signal. In some embodiments the path may comprise at least a portion of one or more navigable segments approaching the location of the traffic control signal, and the method may comprise the step of identifying such a navigable segment or segments, and obtaining positional data relating to the movement of one or more devices along at least a portion of the segment approaching the location of the traffic control signal. The navigable segment and the location of the traffic control signal may both be defined in digital map data. The navigable segment(s) may be road segment(s). The location of the traffic control signal may be any suitable reference point, but in preferred embodiments is indicative of a location of a stop line associated with the traffic control signal.

In some embodiments the method comprises using the positional data relating to one or more devices to determine data for each device indicative of one, and preferably both, of: a time at which the device passed through the traffic control signal; and a point at which the device began to accelerate away from a waiting state to pass through the traffic control signal. The method may then comprise using the determined data in determining the transition time data for a given past transition of the traffic control signal. The point at which a device began to accelerate from the waiting state may be a point in time or more preferably a spatial point, i.e. position. The position may be an absolute position or a position relative to the location of the traffic control signal. In preferred embodiments the waiting state is a position at which the device was stationary. Thus the waiting state is preferably a standstill state. The position at which the device began to accelerate away from the waiting state is then a position at which the device transitioned to a moving state. In other arrangements, it will be appreciated that the waiting state might be a state in which the device had a non-zero speed, e.g. in which a vehicle slowed to a waiting speed in order to avoid coming to a complete standstill, or did not decelerate to a complete halt before the a phase transition of the signal occurred. The point at which the device began to accelerate away from a waiting state is a point at which the device last began to accelerate before passing through the signal, and preferably at which the device last begins to move away from a stationary position before passing through the signal. The appropriate point may be readily identified from the positional data (or trace) of a device.

In preferred embodiments the method may comprise determining a distance of the or each device, whose positional data is used to determine a given transition time, from the location of the traffic control signal at the point at which the device began to accelerate away from the waiting state. In preferred embodiments in which the device is stationary in the waiting state, this distance will correspond to the position at which the device last waited in a queue before passing through the traffic control signal. Thus, in embodiments the method comprises using the positional data relating to a device to determine data indicative of one, and preferably both, of: a time at which the device passed through the traffic control signal; and a distance of a point at which the device began to accelerate away from a waiting state to pass through the traffic control signal from a location of the traffic control signal, and using the determined data in determining the transition time data for the device.

The time at which the device passes the location of the traffic control signal may be determined by reference to the time at which the position of the device corresponded to the location of the control signal, e.g. a stop line thereof. This may be determined by reference to the timestamp associated with the relevant positional data for the device.

The position at which the device last accelerates away from a waiting state before passing through the traffic control signal, e.g. at which the device transitions between a standstill state and a moving state before passing through the signal, may be taken to be the last position at which the device, e.g. vehicle associated therewith, waited, e.g. at a standstill, in a queue before accelerating to pass through the traffic control signal. It can be assumed that at the time the device was held in this position, the signal must have been indicative of a stop phase, e.g. a red phase. As described above, this position is preferably used with the location of the traffic control signal to determine the distance of the device from the signal when waiting in the queue. It has been found that this information may be used to obtain data indicative of a transition time between the stop-go phases of the signal, e.g. a red-green transition. Once the signal transitions from the stop phase to the go phase, e.g. red-green, it has been established that a queue of traffic can be assumed to dissolve at a constant speed; this constant speed at least in some embodiments being 15 km/h (as determined from empirical data). Thus, in embodiments a dissolving speed is used together with the information regarding the point at which the device starts to accelerate away from the waiting state before passing through the signal, or the distance of the device from the signal when in the waiting state before passing through the signal, and the time of passing the signal, to obtain an estimated transition time between stop and go phases of the traffic control signal.

The transition time data in respect of a given transition time obtained in accordance with any of the methods discussed above is determined using positional data relating to a set of one or more devices. Where the set comprises a plurality of devices, the above steps for determining the given transition time may be carried out in relation to each device of the set of devices. In these arrangements, the plurality of devices are devices which may be considered to have waited in the same queue for a given transition. Thus, a given transition time that is determined may be based on data relating to multiple devices. An average transition time may then be determined using some form of aggregation. In other, albeit less preferred, arrangements the transition time data may be obtained using positional data relating to a single device.

In embodiments the method further comprises determining an error associated with a given determined transition time. The error in such a determination may be proportional to the magnitude of the distance between the point at which each device (whose data is used in determining the given transition time data) accelerates away from the waiting state to pass through the traffic control signal and the location of the control signal, i.e. the distance from the signal at which the device waited.

The transition time in relation to which information is determined in accordance with these embodiments of the invention is information relating at least to a given past transition time. However, as the data is preferably determined on the basis of live data, the transition time is in the recent past, and can be used to support inferences about future transition times as discussed below.

The transition time is a time at which a transition between different phases of the traffic control signal has occurred, e.g. between stop and go phases. In accordance with the invention, the method comprises using the or each determined transition time to predict one or more future times at which a transition between phases of the traffic control signal is expected to occur. Preferably the transition whose timing is predicted is a transition between corresponding phases of the traffic control signal, i.e. the same transition type as the or each transition for which a transition time has been determined.

In preferred embodiments the method comprises determining data indicative of a plurality of different times at which a transition of the traffic control signal has occurred using positional data indicative of the movement of a plurality of devices. The method may then comprise using the transition time data indicative of the plurality of transition times in predicting the one or more future transition times. The different past transition times are preferably times of a corresponding transition type, i.e. between the same first and second phases of the signal.

In some preferred embodiments the method comprises using positional data relating to each device of a first set of one or more devices to determine data indicative of a first given past transition time of the traffic control signal, and using positional data relating to each device of at least one further set of one or more devices to determine data indicative of a time at which a respective further given past transition of the traffic control signal occurred. Preferably positional data relating to the or each device of each of a plurality of further sets of one or more devices is used to determine data indicative of a plurality of further respective given past transition times of the traffic control signal. The, or each, given past transition time is preferably in relation to a corresponding transition type of the signal, i.e. from a first given phase to a second given phase.

The present invention further comprises using the transition time data that is determined using the positional data to predict a time or times at which a future transition between phases of the traffic control signal is expected to occur.

Merely by determining information indicative of a time of a transition that has occurred, it may be possible to predict a future transition time, e.g. where it can be assumed that the same transition will occur at a corresponding time on the next day, on a corresponding day in the next week, etc, or where information regarding a cycle time of the signal is already known. Thus, a prediction may be made based upon data indicative of a single transition time. However, the present invention may provide "live", i.e. short term, predictions about transition times based on current or near current data, and it has been found that by obtaining data indicative of a plurality of transition times, the transition time data may advantageously be used to obtain a cycle time based on the live positional data for use in predicting future transition times.

In some embodiments the method comprises determining a cycle time of the traffic control signal, and using the cycle time in providing the prediction, i.e. together with the determined transition time data. The method preferably extends to determining the cycle time. The step of determining the cycle time may simply comprise obtaining a predetermined cycle time, e.g. from stored data, e.g. in respect of a time period of interest. However, in preferred embodiments the method further comprises determining the cycle time using the transition time data determined in accordance with the invention (potentially in combination with other data).

As the positional data is "live", at least in preferred embodiments, this enables cycle time to be more accurately predicted, at least for the new future, even where cycle time may vary throughout the day and/or week, rather than relying upon information obtained, e.g. from third parties. It will also be appreciated that third party information may also be inaccurate in cases where the signal does not, in fact, operate exactly according to the intended timing.

The method may comprise using the cycle time information to predict the one or more future transition time, i.e. a future time at which the traffic control signal is expected to transition between phases. The cycle time information is preferably used with the transition time data determined using the positional data to predict the or each future transition time. The or each predicted transition time is preferably a time within the next 30 minutes, 1 hour or 2 hours. Where the predicted transition time is in the short term future, it may be assumed that any cycle time determined on the basis of the live positional data, e.g. by consideration of the determined past transition times, may be valid for predicting the future transition time(s).

In preferred embodiments in which data indicative of a plurality of different given past transition times for the traffic control signal is determined using the positional data, the method preferably comprises using the different given past transition times to determine data indicative of a cycle time for the traffic control signal. The step of determining a cycle time of the traffic control signal may comprise determining a time difference between one or more, and preferably a plurality of, different pairs of past transition times obtained using the positional data, and determining the cycle time using the or each time difference. It may be assumed that corresponding transitions in phase will occur at times separated by an integer number of cycles of the traffic control signal. Different candidate cycle times may be tested to determine a cycle time that best fits the transition time data. The method may therefore comprise the step of fitting a cycle time to the or each determined time difference. The method may comprise testing a plurality of candidate cycle times to determine a cycle time that best fits the or each time difference between the pair or pairs of determined transition times. In some embodiments the method may comprise determining data indicative of a cycle time for the traffic control signal that corresponds to a time which best fits the differences between pairs of transition times determined using the positional data.

In determining a best fit for the cycle time, or otherwise deriving a cycle time from the transition time data, other data may be used to help select a suitable cycle, e.g. to narrow down effort when determining a "best fit" cycle time. For example, in some embodiments the step of determining a cycle time further comprises using "historical" positional data relating to the movement of a plurality of devices with respect to time along the path controlled by the traffic control signal. In these embodiments the historical positional data may be used with the transition time data based on the live positional data to determine a cycle time. The method may comprise using the historical positional data to determine an approximate cycle time or range of cycle times, and using the transition time data obtained using the live positional data to provide a refined determination of cycle time based on the approximate cycle time or range of cycle times. For example, the historical positional data may be used to determine an approximate cycle time or range of cycle times that are used in the process of determining a cycle time that fits the differences between pairs of transition times determined using the live positional data. In embodiments a step of testing a plurality of candidate cycle times to determine a time which best fits the or each time difference between the determined transition time(s) comprises using the historical positional data to select the candidate cycle time(s).

The historical positional data may be in respect of a given time period including the or each transition time determined based on the live positional data. This may ensure that the historical data is relevant to the time period in question, as cycle time may vary throughout the day, on different days of the week, etc as discussed above.

Any of the steps below relating to the way in which historical positional data may be used to obtain data indicative of a cycle time, i.e. an estimate or approximation of cycle time, may be used in conjunction with the first and second aspects of the invention where historical data is used in determination of the cycle time based on the transition time data.

It is believed that the use of aggregated positional data relating to the movement of devices with respect to time over an extended period of time, e.g. weeks, months, etc, to determine the cycle time of a traffic control signal is advantageous in its own right.

Thus, from a further aspect of the invention there is provided a method of determining information relating to the operation of a traffic control signal, the method comprising:

using positional data relating to the movement of a plurality of devices with respect to time along a path controlled by the traffic control signal to determine data indicative of a cycle time of the traffic control signal.

In a preferred embodiment of this aspect of the invention the method comprises:

obtaining positional data relating to the movement of devices with respect to time along a path controlled by the traffic control signal;

analysing the positional data to identify a plurality of devices having at least one standstill period during movement along the path and to determine, for each of the plurality of devices, data indicative of a time at which the at least one standstill period occurred; and using the determined data indicative of a time at which the at least one standstill period occurred to determine a cycle time of the traffic control signal.

In accordance with a further aspect of the invention there is provided a system of providing information relating to the operation of a traffic control signal, the system comprising:

means for using positional data relating to the movement of a plurality of devices with respect to time along a path controlled by the traffic control signal to determine data indicative of cycle time of the traffic control signal.

In a preferred embodiment of this aspect of the invention the system comprises:

means for obtaining positional data relating to the movement of devices with respect to time along a path controlled by the traffic control signal;

means for analysing the positional data to identify a plurality of devices having at least one standstill period during movement along the path and to determine, for each of the plurality of devices, data indicative of a time at which the at least one standstill period occurred; and means for using the determined data indicative of a time at which the at least one standstill period occurred to determine a cycle time of the traffic control signal.

The present invention in these further aspects may include any or all of the features described in relation to the previous aspects of the invention, and vice versa, to the extent that they are not mutually inconsistent.

In accordance with these further aspects or embodiments of the invention the positional data is preferably historical positional data relating to the movement of devices with respect to time in relation to a given time period, e.g. time of day, day of the week, etc. The time period should be chosen such that it may be assumed that the cycle time will be constant over the relevant period. The period may be of any duration as desired. For example the period may be a 1 hour period or an other integer period of hours. The method of these further aspects may be performed in respect to multiple time periods, e.g. different periods in which the cycle time may differ. The steps of the method may be repeated for each time period in respect of which cycle time information is required. The time periods are selected to be long in comparison to the expected cycle time.

The method may comprise obtaining the positional data relating to the movement of a plurality of devices with respect to time along the path controlled by the traffic control signal, and preferably in the given time period. The positional data may be obtained in any of the manners described above. The method may comprise receiving positional data and filtering the relevant data therefrom, or obtaining, e.g. filtering, the relevant data from stored positional data. Thus, the method need not include the step of receiving the positional data from the devices.

The method may comprise identifying one or more devices whose positional data with respect to time is indicative of the device having one or more standstill periods during movement along the path, i.e. along a navigable segment or segments defining the path, and preferably in the given time period. This identification may be carried out by reference to the speed of the devices along the path. Those devices which have a standstill period can be assumed to have been stopped due to the phase of the signal. Of course, a device may have one or more standstill periods along the path approaching the location of the traffic control signal, e.g. where it was held by the signal for multiple cycles. The method may then comprise determining the timing of the or each standstill period for the device or devices having such period(s), preferably within a given time period. In preferred embodiments, the one or more devices are devices that traveled along the path controlled by the signal in a given time period, and thus the identified devices are devices having a standstill period or periods within the given time period.

The method may further comprise using the data indicative of a timing of the or each standstill period of the or each device to determine a cycle time based on the positional data, preferably in respect of a given time period. The method may comprise selecting a candidate cycle time, and determining, for each device having a standstill period as indicated by the positional data, an offset of a timing of the standstill period with respect to a reference point of a nearest cycle based on the candidate cycle time, and repeating the steps for different candidate cycle times to obtain the cycle time that best fits the standstill data. Preferably the step is carried out with respect to a given time period, and each device is a device having a standstill period within the given time period as discussed above.

The method may comprise taking the start of the given time period to correspond to a reference point of a cycle, e.g. a start point thereof. It will be appreciated that the time period is longer than the or each candidate cycle time. The offset of the timing of the standstill period may be taken with respect to any reference time associated with the standstill period, provided that the same reference is used for each standstill period. In embodiments the offset is an offset of a start time of the standstill period with respect to the reference point, e.g. start point of the nearest cycle. The step of determining a cycle time that best fits the standstill data may comprise determining a histogram of the offset data in respect of different devices for each candidate cycle time, e.g. within the given time period. The method may comprise selecting a cycle time which provides a central peak as being the best fit.

The candidate cycle time derived using the above described methods, e.g. from historical positional data, may then be used in determining or selecting a cycle time for use in the methods of the previous aspects of the invention, e.g. providing a starting point when estimating a cycle time based on the transition time data. In other words, the cycle time data obtained based on (historical) positional data may be used to calibrate the test cycles used to determine a cycle best fitting the transition time data. Alternatively the cycle times according to (historical) positional data may be used directly in the first method to provide a cycle time for use with determined transition time data to predict future transition times. Thus in these arrangements the live positional data would not be used in determining cycle time.

The prediction of the transition time obtained in accordance with the invention in any of its aspects or embodiments may be used in various manners. The method may further comprise using the prediction in carrying out one or more of: providing a speed recommendation to a driver or Advanced Driver Assistance System (ADAS); providing information regarding a waiting time at the signal; and determining an estimated travel time along a path involving passing through the traffic control signal. For example, a speed recommendation may be determined to allow a driver to pass through the traffic control signal when following a path that involves passing through the signal with minimal waiting time and/or in a more fuel efficient manner. For example the driver or an ADAS may be provided with a speed recommendation which is intended to result in the vehicle passing through the signal to coincide with a "go" (or "green") phase, or which will minimise stoppage time. A driver or ADAS may be provided with a recommendation as to whether to cut the vehicle engine while waiting at the signal or not, depending upon whether this is likely to be most fuel efficient based upon the expected waiting time.

The method may comprise a server providing the prediction of a future transition time of the signal, or information determined based thereon, e.g. a speed recommendation, to a navigation device or ADAS, e.g. for use in providing the speed recommendation or other information such as to a driver. In these embodiments, the processing of the positional data to obtain a prediction of a future transition time is carried out by a server, thus reducing the computational burden on a navigational device or ADAS.

Alternatively or additionally the method may comprise storing the data indicative of a predicted future predicted transition time or times and/or data allowing the prediction to be made, e.g. the past transition time data and any determined cycle data. In embodiments the method further comprises storing the transition time data determined and optionally determined cycle data for the signal. The data, i.e. any or all of the predicted transition time, determined past transition time or cycle data, may be stored in association with data indicative of the traffic control signal to which it relates, e.g. indicative of a location or other identifier of the signal. The stored data may be accessible to navigation devices or ADAS, or may be supplied to third parties to provide more accurate information about the operation of the traffic control signal.

A navigation device as referred to herein may be a vehicle based navigation device, and may be a PND or integrated device.

While the invention has been described in relation to determining transition time information in relation to a given traffic control signal, the method may be implemented in relation to determining corresponding data for any number of traffic control signals. For example, where such data is known for a series of such signals, it may be used more effectively to guide a driver e.g. to ride a "green wave" through the signals, or otherwise traverse the signals in a time and/or fuel efficient It will be appreciated that the methods in accordance with the present invention may be implemented at least partially using software. It will this be seen that, when viewed from further aspects, the present invention extends to a computer program product comprising computer readable instructions adapted to carry out any or all of the method described herein when executed on suitable data processing means. The invention also extends to a computer software carrier comprising such software. Such a software carrier could be a physical (or non-transitory) storage medium or could be a signal such as an electronic signal over wires, an optical signal or a radio signal such as to a satellite or the like.

The present invention in accordance with any of its further aspects or embodiments may include any of the features described in reference to other aspects or embodiments of the invention to the extent it is not mutually inconsistent therewith.

Advantages of these embodiments are set out hereafter, and further details and features of each of these embodiments are defined in the accompanying dependent claims and elsewhere in the following detailed description.

BRIEF DESCRIPTION OF THE DRAWINGS

Various embodiments of the present invention will now be described, by way of example only, and with reference to the accompanying drawings in which:

FIG. 7 shows a set of determined cycle times for a particular set of crossings.

DETAILED DESCRIPTION OF THE FIGURES

Figure 1:
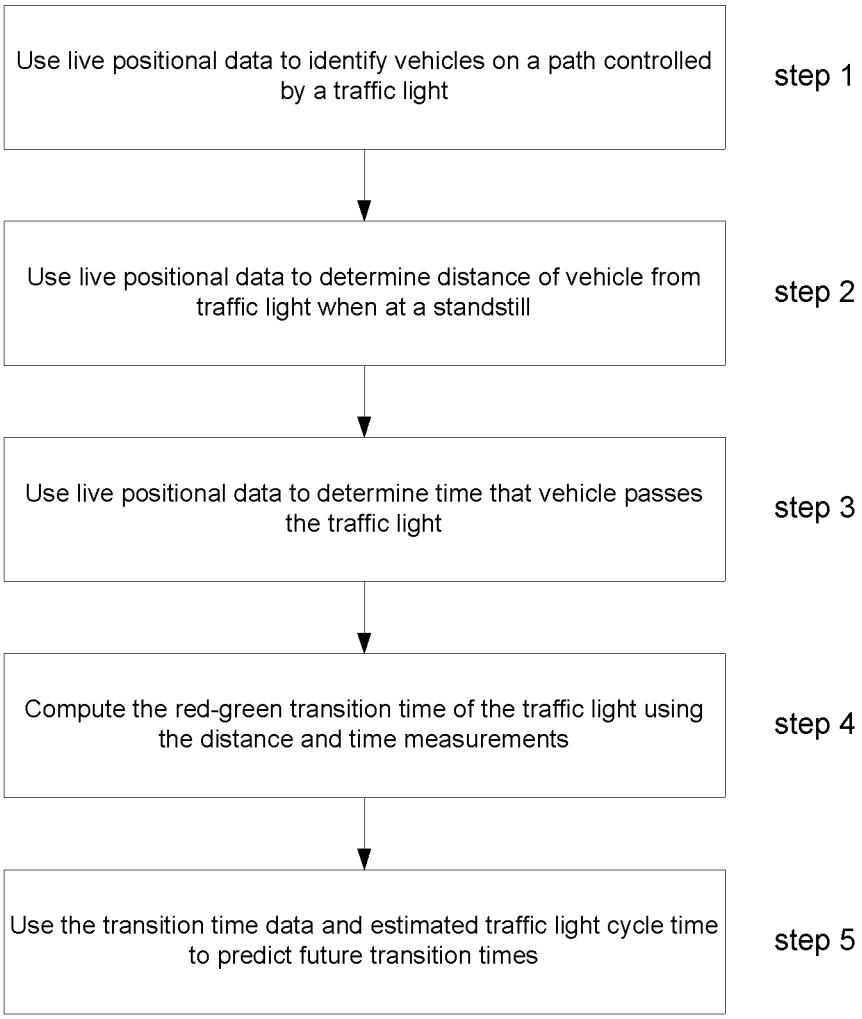
FIG. 1 shows a flow diagram of a method in accordance with a preferred embodiment of the present invention.

FIG. 1 is a flow chart of an embodiment illustrating how the methods in accordance with certain aspects of the present invention can be used to determine information about transition times of a traffic control signal of a traffic control system, and to predict future transition times of the signal. The traffic control signal may, for example, be a traffic light controlled crossing. The method exemplified by FIG. 1 is realized in a live system using live positional data, i.e. using positional, e.g. GPS probe, data available for analysis within a short period of time, e.g. 3 minutes. The probe data is vehicle probe data received from devices associated with the vehicles, e.g. GPS devices, whose position corresponds to that of the vehicle. The probe data may alternatively be referred to as "positional data". The probe or positional data is associated with temporal data. The probe data can be used to derive probe traces relating to travel of probe vehicles in a geographic region which includes the traffic control signal of interest.

It has been found that such probe data may be used to infer exact points in time for which the traffic light had a green phase or a red phase. For example, positional data obtained from probe vehicles close to and/or passing by a traffic light with a known location can be classified as standstill (indicating a red light) and free flow (indicating a green light). The green phase depends on the road on which the vehicle approaches the traffic light as well as the road the vehicle takes after passing the traffic light, i.e. the green phase might be direction dependent. Thus, relevant probe data used to determine the traffic light phase is determined based on the path taken by vehicles through the traffic control signal, e.g. to relate to a straight ahead path or left turn path, etc, depending upon the path of interest.

Step 1 of the method in accordance with the embodiment illustrated in FIG. 1 comprises using live probe data to identify probe traces associated with vehicles which are travelling along a given path controlled by a traffic light of a certain traffic control system. This may be done by consideration of the location of a portion of a road segment or segments defining the path, and the location of the traffic light. Where the traffic light is arranged to control multiple paths of traffic, e.g. a straight ahead path and a left turn, the probe data relating to a subset of vehicles following the path of interest is identified.

Figures 2, 3:
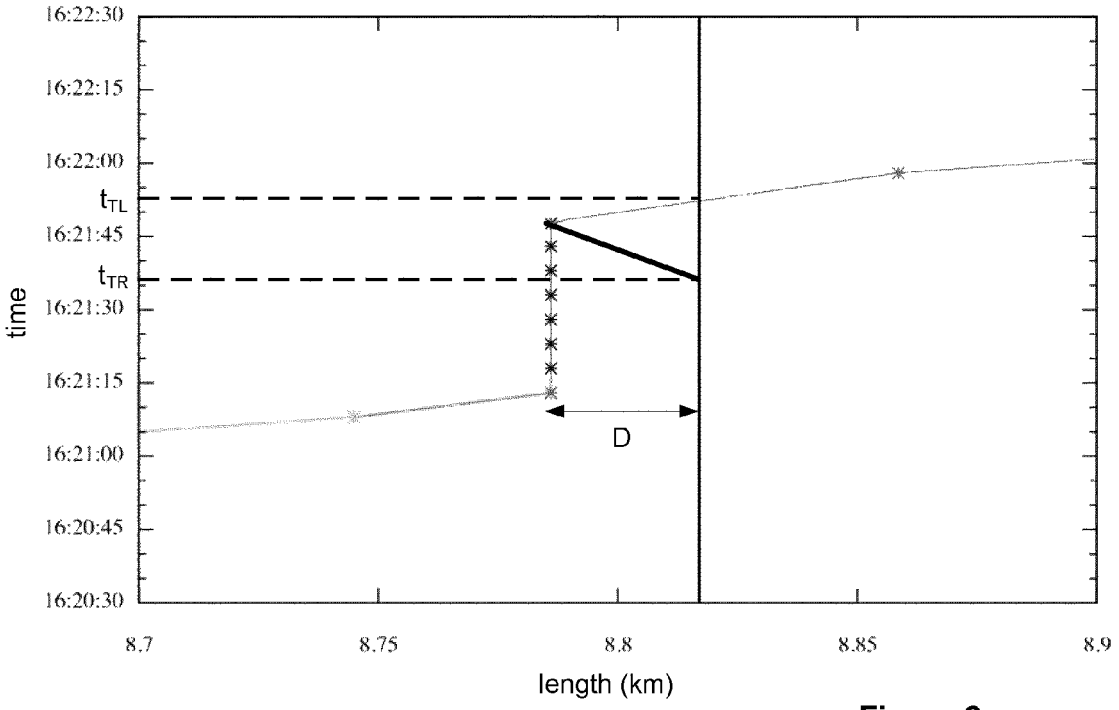
FIG. 2 shows a typical distance-time probe trace of a vehicle depicting slowing down, standstill and dissolving characteristics before a traffic light, and which may be used to determine transition time information in accordance with the invention.
FIG. 3 shows a table of time differences between transition times determined in accordance with the invention.

FIG. 2 is a typical probe trace of a vehicle approaching a traffic light located between 8.8 and 8.85 km from a reference point (at the thick vertical line). The probe trace indicates the position of the vehicle with respect to time. The reference point may be the start of a road segment containing the position of the traffic light. The probe trace indicates that the vehicle is stationary between times being approximately 16:21:10 and 16:21:50, (hour:min:sec). During this period the vehicle is at a standstill a distance, D, from the traffic-light. In accordance with step 2, this standstill distance D is determined. It may be assumed that this standstill period corresponds to a period in which the vehicle is held at a standstill due to a red phase of the traffic light.

At the end of the standstill period, the vehicle begins to move. The time that the vehicle begins to move may be assumed to be at some point after the phase of the light has transitioned from red to green. Thus, typically the standstill period extends for some additional time after the phase transition of the light, until the queue of traffic has dissolved to an extent to allow the vehicle to move forward. Once the phase of the light changes to green, the traffic queue that has been held at a standstill by the red light dissolves and the vehicle crosses the position of the traffic-light at a time, $t_{TL}$. In accordance with step 3 of the method, this time $t_{TL}$ is determined. Of course, similar techniques may be applied to determining red-green transition times of a light where a vehicle does not come to a standstill before passing through the light. Instead the time of the end of a waiting period of non-zero velocity, at which time the vehicle starts to accelerate to pass through the light may be determined.

According to empirical studies, It has been found that a traffic light queue dissolves at nearly a constant speed, $v_d$=15 km/h. The time of the red-green transition can therefore be computed as the difference between the time $t_{TL}$ for the vehicle to pass the traffic light and the time for the queue to dissolve, i.e. $t_{TR}=t_{TL}-D/v_d$. The dissolving time for a car is approximately $t_d=D/v_d$.

In this way, the probe trace of a given vehicle passing the traffic-light provides an estimate, m, of a transition time, $t_{TR}$, of the light between the red and green phases (step 4). This estimate is associated with an approximate error, E, which has been found to be linear with respect to D, the distance of the vehicle from the position of the traffic light when at a standstill. The error E may additionally or alternatively take into account a deviation of a plurality of determined measurements from an average. Thus multiple measurements for a given $t_{TR}$ may be determined using probe data for different vehicles, e.g. at different points in a queue. However, in preferred arrangements data from a single probe vehicle is used to determine a given $t_{TR}$. The error E is determined for the estimated transition time of the light determined from the vehicle probe trace. As an example, observations from 10 cars waiting at approximately the same distance, D, from a traffic light were taken. It took on average 9.9 seconds to pass the traffic light with standard deviation 0.54 sec.

The above steps are repeated for a number of different vehicles having probe traces indicative of travel along the path controlled by the traffic light in a given time period, e.g. 30 minutes, to obtain estimates m of further red-green transition times of the traffic light in the time period. To minimise error, the steps are carried out with respect to vehicles which are located at a similar distance D from the traffic light when at a standstill.

According to step 5, assuming a fixed traffic-light cycle time, t, for a particular time slot which cycle time may be computed a priori, as described below or otherwise known, future transition times can be predicted from the transition times determined in step 4.

The cycle time used in step 5 to predict the occurrence of future transition times can be determined either from live positional data as will be described by reference to FIGS. 3 and 4 below, or using historical aggregated data as determined by reference to the second embodiments below, or by combinations thereof. It is understood that the cycle time may also be determined in other ways, or otherwise known, or by reference to stored data. When using older transitions, or out-of-date estimates of the cycle time, then an aging factor can be introduced to increase the approximation error associated with predicting future transition points.

The traffic-light cycle time, t, can be calculated using the measured transition times, m, assuming that the traffic-light cycle has a fixed cycle time. In this embodiment, the cycle time is estimated from only a few recent live probe traces. In this way, the method may be efficient in terms of processing power, and also is not susceptible to imprecise clocks controlling the traffic lights, being based on inferences about the actual operation of the light.

By way of example, a set of 4 measurements based on probe traces of vehicles and taken within 30 minutes of each other could provide the following transition times and errors:

$m_1$=08:10:47+/−9 s $m_2$=08:17:20+/−4 s $m_3$=08:29:15+/−8 s $m_4$=08:38:43+/−2 s

The error for each measurement ($E_1$, $E_2$, $E_3$, . . . ) can be calculated by observing the deviation of each measurement from the average, or by directly considering distance (D) for each vehicle (based on the assumed linear relationship between D and E).

The time differences between every pair of measurements, and average error per pair, can then be calculated as illustrated in FIG. 3. Each time difference ($m_{xy}$) should approximately correspond to an integer multiple of time cycles. So, potential cycle times ($t_1$, $t_2$, . . . ) are tested to determine to how exact multiples of each of them fit in the time intervals, $m_{xy}$. A cycle time that best fits with the intervals defined by the time differences is chosen to be the determine cycle time for the particular traffic light in the time period within which the measurements are made. The fit of the cycle time may be assessed by reference e.g. to minimum deviation or error.

For each potential cycle time, t, the closest multiple to the time intervals and the error associated with each potential cycle time and pair of measurements are computed and subsequently the error associated with each potential cycle time and all pairs of measurements. The squared time difference for each pair of measurements and the average squared time difference of all pairs, weighted by reciprocal squared approximate errors are suitably used. The average squared time difference may be further weighted by the reciprocal of a given cycle interval, since the analysis may be biased towards small intervals.

Figure 4:
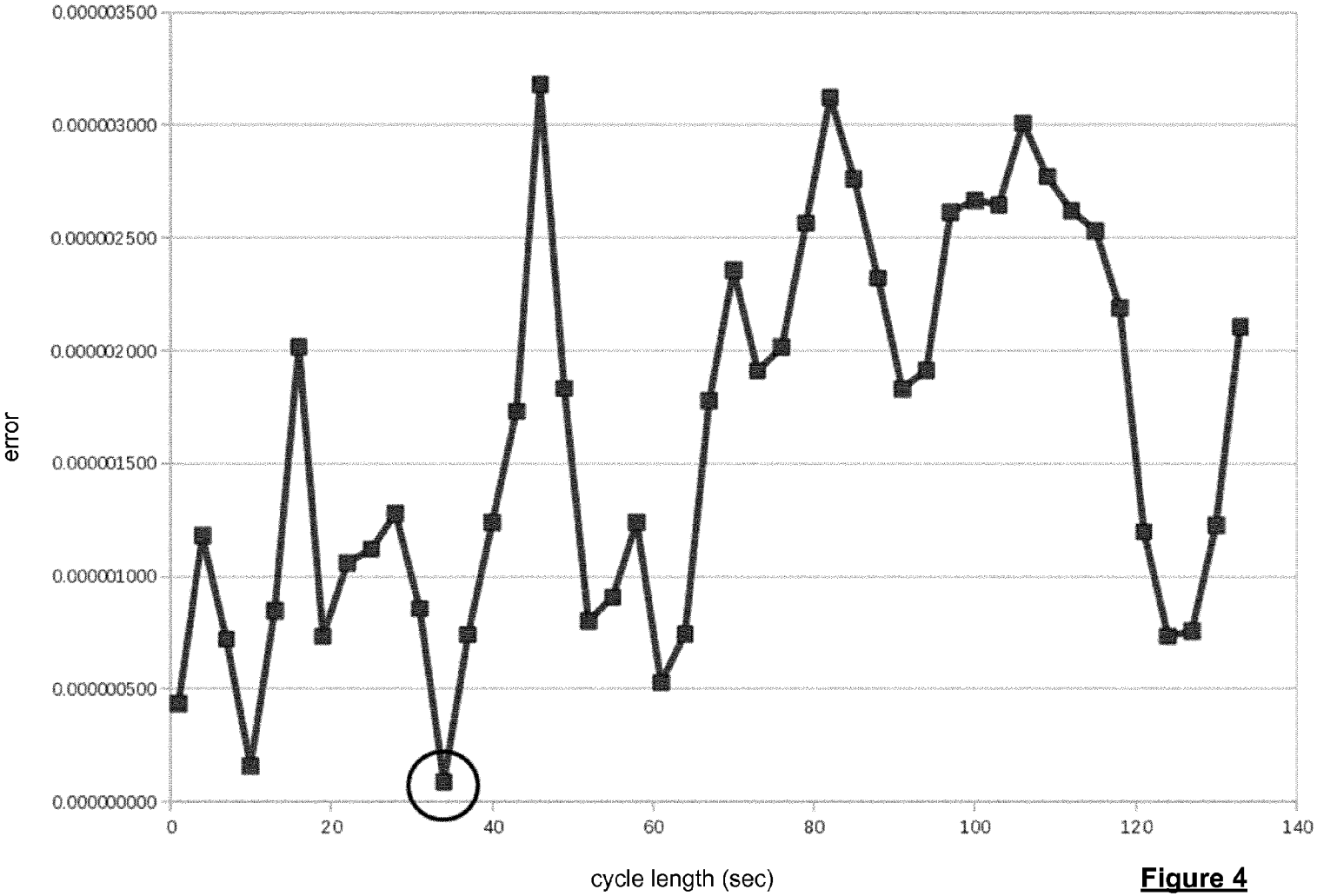
FIG. 4 shows the errors corresponding to fitting the measurements of FIG. 3 with a series of potential cycle times (0-140 seconds)

FIG. 4 shows the results of such an analysis for the measurements in FIG. 3. A series of potential cycle times (0-140 seconds) and the errors corresponding with the fitting of the potential cycle times to the measured time differences are plotted. The potential cycle time giving rise to the lowest associated error is chosen as the best estimate. In this example, the potential cycle time that best fits the time difference between measurements is found to be 35 seconds, as marked on the graph.

Reasonable upper and lower bounds may be chosen so as to narrow the selection of potential cycle times (for example, 30-120 seconds). These bounds could be placed, for example, by assuming that within each time interval there is at least one transition, by considering the frequency at which probe vehicles pass the crossing and/or from using probe data from individual vehicles which are at a standstill for multiple cycles of the traffic-light system.

In another embodiment, cycle time measurement can be computed using historically aggregated vehicle probe data rather than using live probe data. This method may be used independently or in conjunction with the method described by reference to FIGS. 1-4. Cycle times obtained using historical data may be used to determine approximate cycle times for the traffic light in a given time period, which may then be used as a starting point when determining a cycle time that best fits transition data obtained based on live probe data as described by reference to FIG. 1, i.e. in fitting a cycle time to data of the type shown in FIG. 3. In other words, the historical traffic light cycle data may be used to select cycle times to try to fit to the transition time data in order to obtain a more accurate cycle time based on the live data. Alternatively, historical data could be used to provide a cycle time which is used directly in predicting future transition times using transition times determined based on live data, without necessarily using the transition time data itself to derive a cycle time.

It will be appreciated that using such historically aggregated data gives most accurate results when the traffic control system is operated according to a certain time pattern, i.e. with a repeating pattern within a certain time period (day, week, month, etc). If this condition is satisfied, there is a cycle time t such that the state of the traffic light repeats after t units of time. Each hour can have a different program, and the program can vary on different days of the week.

Historical probe data is collected relating to movements of vehicles travelling along a path subject to control by the traffic light of interest. This may be done in a manner similar to the embodiments using live probe data, e.g. by filtering data relating to movements along the navigable segment(s) in the region of the traffic light.

The data may be obtained from a suitable database of historical probe data. In such a database the probe traces are typically matched to road segments. As the location of the traffic light of interest and the section of the road network affected by the traffic light is known, the relevant probe traces associated with this section of the road network may be selected.

Figure 5:
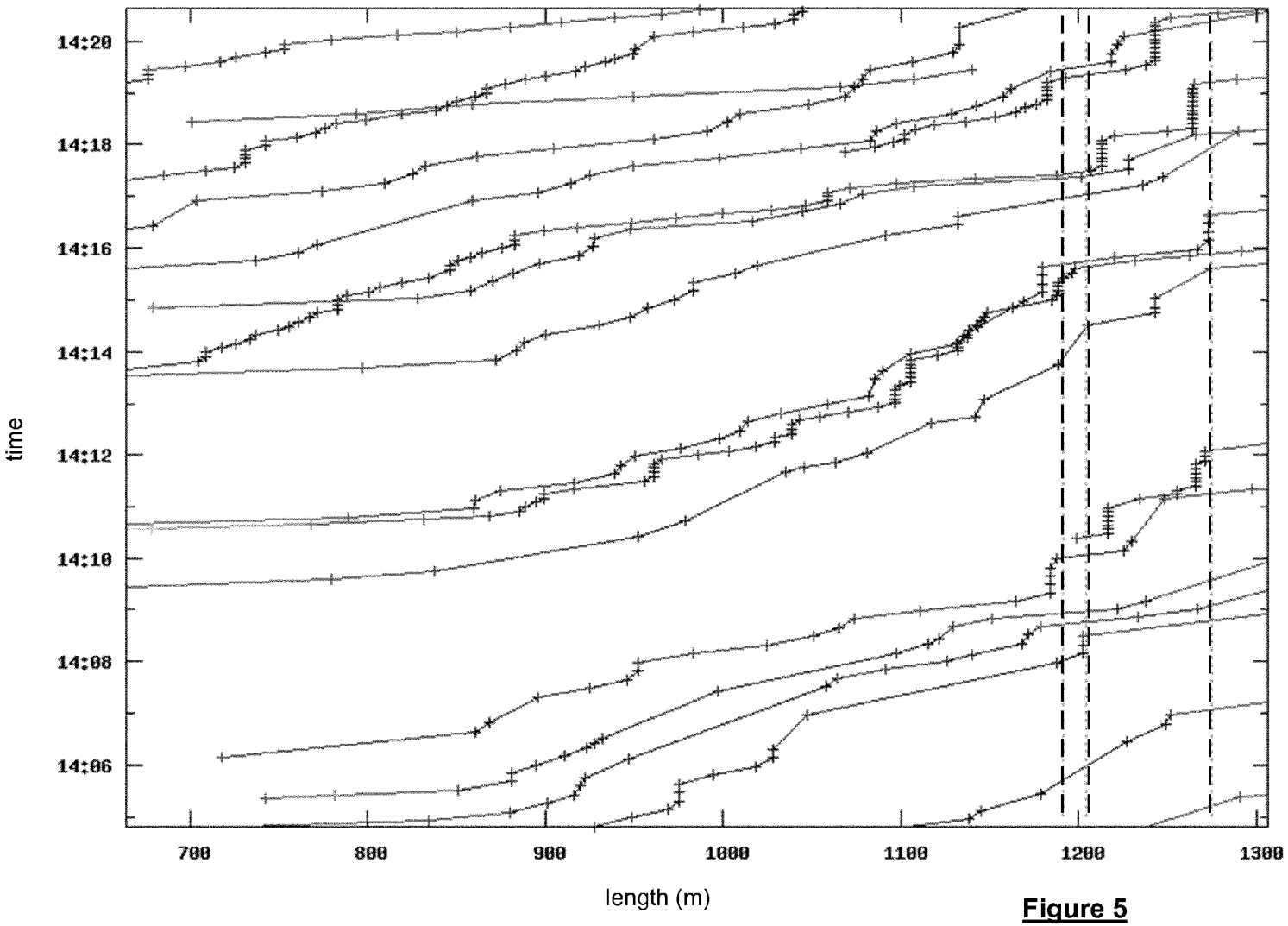
FIG. 5 shows a distance-time plot of probe traces of a plurality of vehicles travelling along the Münchener Straβe in Berlin depicting inter alia periods of standstill in front of junctions.

Each probe trace is analysed to determine those times at which the vehicle is stationary. Any probe trace including a standstill period may be assumed to relate to a vehicle that was held stationary due to the traffic light being red. For each standstill period of a trace a start time and an end time of the period is determined. The identified standstill period times are then binned into relevant one of a plurality of timeslots. This may be done by reference, for example, to a start time of each standstill period. FIG. 5 shows a distance-time plot of probe traces of a plurality of vehicles travelling along the Münchener Straβe in Berlin, Germany depicting inter alia periods of standstill in front of junctions (shown as dashed vertical lines).

In this embodiment, it is assumed that the cycle time is constant for a specific time slot (a combination of hour and day of the week) and that the control program for each time slot starts with the same cycle phase, i.e. the cycle phase is assumed to be the same every Sunday at 9:00:00 for this time slot over a period of several weeks. The standstill period times may be binned into such time slots, e.g. 1 hour slots for each day of the week. Data obtained from probe vehicles travelling in corresponding timeslots in different weeks may be combined when binned into the timeslots.

A trial fixed cycle time, t, is assumed and the time slot (for example Sunday 9:00:00 to 10:00:00) is divided into cycles each starting with the same phase. For a cycle time of t=100 s, the time slot may thus be divided into cycles starting at 9:00:00, 9:01:40, 9:03:20, etc.

For every standstill time measurement allocated to a given time slot, the offset to the nearest start time of a cycle is computed. A histogram of these offsets is created for each time slot. The process is then repeated for various trial cycle times. The offset may be with reference to a start point of a standstill period.

For example, trial cycle times being all reasonable multiples of 1 second may be tried and a histogram created for each trial cycle time. Upper and lower bounds can be placed on the trial cycle times, using stop times of individual vehicles for example. For example, a search may be carried out for vehicles that are stationary at two or more different locations on the path controlled by the traffic light, indicative of the vehicles being stopped for at least two cycles.

It is contemplated that the time slot may be divided into cycles in various ways. For example, the time slot could be divided into cycles such that the first start of a cycle corresponds with a first standstill period, i.e. with a start point thereof. This may be suitable if there are a large number of measurements (e.g. transition points) within the time slot, which may not be the case for a busy crossing. Alternatively, once the cycle time has been determined, precise measurements of the transition times, e.g. determined using the embodiment of FIG. 1 above can then be used to calibrate the cycle time/phase. This calibration may be necessary since the internal clocks associated with the traffic control system may be imprecise. Measurements taken by probe vehicles on the other hand have exact times associated with them.

In one example, for each time slot a first time at which a vehicle is stationary is identified, and assuming there is sufficient data this time can be taken as a starting point of the traffic light cycle time. A first trial cycle time is selected, and an offset between each measured first time at which the vehicle is stationary and the appropriate start of the cycle calculated. In other words, if the first stationary vehicle in the time slot 09:00-10:00 is measured at 09:01.31 s, and the cycle time is taken as 100 s:

for a measurement at 09:02.56 s, the measurement is in the 1st cycle and thus the offset is 85 s for a measurement at 09:15.42 s, the measurement is in the 8th cycle (which starts at 09:14.51 s), and thus the offset is 51 s.

However the offsets are defined, when the right cycle time has been guessed, a distinct central peak will appear in the histogram. Since it is assumed that each cycle starts with the same phase, and the measurements are taken at the same phase of the cycle (i.e. transition points), then a distinct peak in the histogram indicates that each measurement has roughly the same offset (in time) from the start of a cycle. A peak thus indicates that the assumed cycle time has the same period as the measurements (whose frequency is controlled by the actual cycle time of the system).

Figure 6:
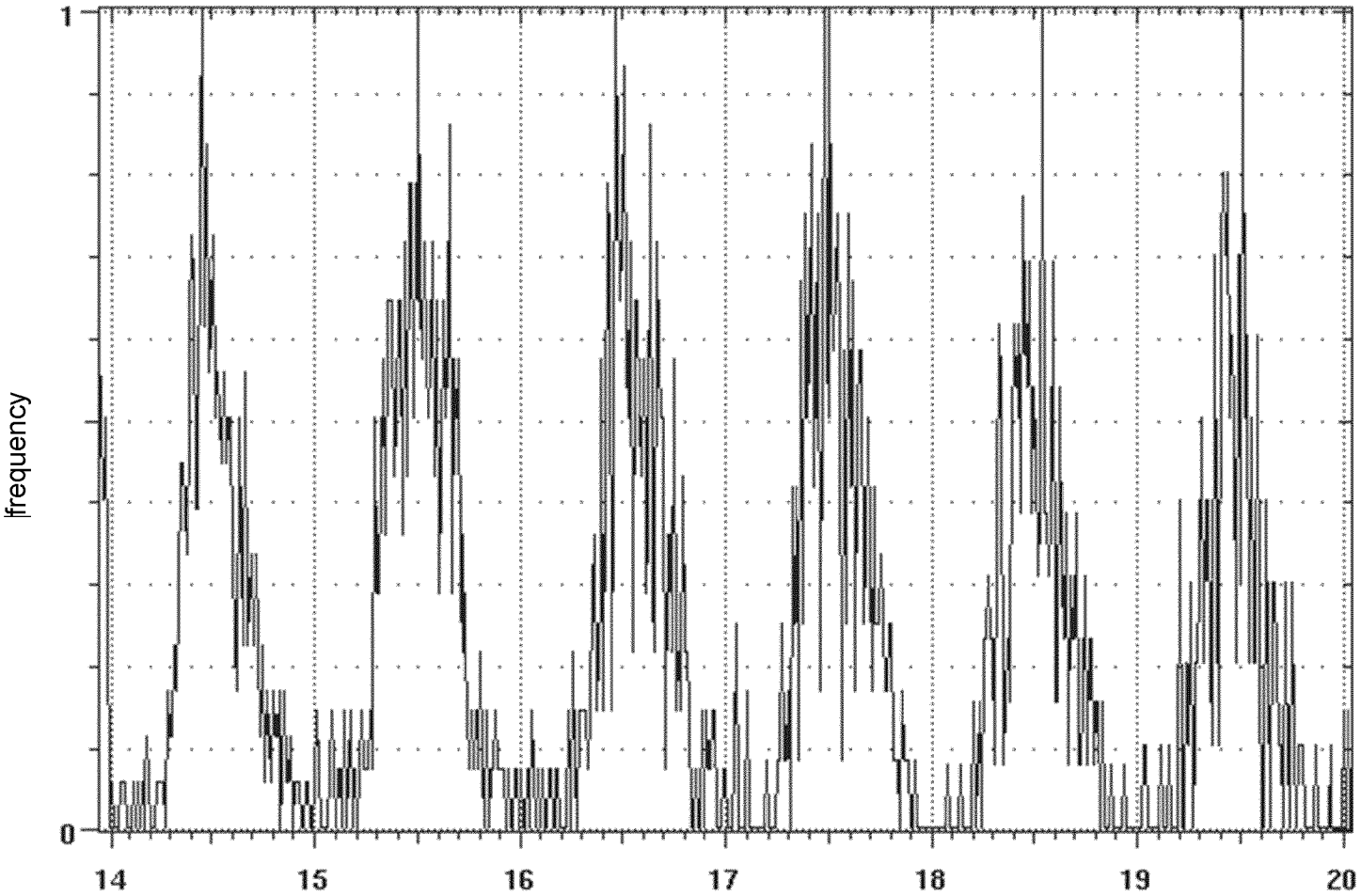
FIG. 6 shows a histogram of the offset of the timing of standstill periods of vehicles approaching a traffic light in given time slots determined using historical probe data, and with respect to the timing of cycles of the traffic light with an assumed cycle length of 100 seconds.

FIG. 6 shows a combined histogram for several time slots (between 14:00 and 20:00 hours on each working day, being slots 14-15 hr, 15-16 hr, 16-17 hr, 17-18 hr, 18-19 hr and 19-20 hr), created using historical aggregated data in accordance with the above described embodiment. The assumed cycle time is t=100 s. For each hour-long time slot, a distinct peak can be seen. The cycle time is thus estimated to be 100 s for each of these time slots.

FIG. 7 provides an exemplary set of cycle time data for the following four crossings in Berlin, Germany:

Crossing C1: (52.5048, 13.61337), B1/B5—Hultschiner Damm

Crossing C2: (52.50418, 13.62060), B1/B5—Pilgramer Str.

Crossing C3: (52.50497, 13.598695), B1/B5—Am Kornfeld

Crossing C4: (52.50852, 13.56148), B1/B5—Blumberger Damm

The data presented in FIG. 6 corresponds to measurements taken at one of these crossings at a weekday between 14-20 hr.

The information determined about the operation of a traffic light in accordance with the invention in its various embodiments may be used in a number of ways. Historical data regarding traffic light cycle times obtained in accordance with the second embodiment of the invention may be stored, e.g. by a server, and/or may be used to provide a database that may be provided to third parties. Predicted future transition times obtained in accordance with the first embodiment of the invention may similarly be stored. Any determined cycle time obtained using the transition time data may also be stored. The information may be stored by a server, or provided by third parties as a database of transition time, and optionally cycle time data. Any cycle time data or transition time data may be stored in association with information identifying the relevant traffic control signal.

The steps of the methods of the present invention may be carried out by a server. In some embodiments cycle time and/or transition time data, whether past or future predicted times, or both, may be provided to an Advanced Driver Assistance System (ADAS) of vehicles or to navigation devices associated with vehicles.

Where predicted future transition time data is determined, the data may be used to provide speed recommendations to drivers to enable them to encounter the traffic light so as to coincide with a green phase, or to enable the driver to drive with greater fuel economy based on an expected operation of the traffic light, e.g. to minimise acceleration and deceleration, or to indicate when it may be appropriate to switch of an engine. The information may be used together with information regarding the operation of other traffic lights to enable more accurate estimations of journey times to be determined, to provide an indication of waiting times to be expected at a light, or to provide recommendations to a driver to ride a "green wave" though lights. Any of these types of information may be provided to a driver, e.g. via a navigation device of a vehicle, or may be used directly to control an ADAS of a vehicle without necessarily being provided to a driver. The information may also be used in planning transport infrastructure, planning operation of traffic control systems, and to uncover any faulty operation of lights, e.g. where the transition data based on live probe data indicates operation is not in accordance with expected operation. Information or recommendations based on the determined information about the operation of the traffic signal may be derived, e.g. by a server using the data, or by a navigation device or ADAS to which the information has been provided.

It will be appreciated that whilst various aspects and embodiments of the present invention have heretofore been described, the scope of the present invention is not limited to the particular arrangements set out herein and instead extends to encompass all arrangements, and modifications and alterations thereto. It should therefore be noted that whilst the accompanying claims set out particular combinations of features described herein, the scope of the present invention is not limited to the particular combinations hereafter claimed, but instead extends to encompass any combination of features or embodiments herein disclosed irrespective of whether or not that particular combination has been specifically enumerated in the accompanying claims at this time.

The invention claimed is:

1. A method for determining information relating to the operation of a traffic control signal, the method comprising:

using live vehicle probe data comprising positional data relating to the movement of one or more devices with respect to time in a recent time period along a path controlled by the traffic control signal to determine transition time data indicative of one or more times at which a transition between phases of the traffic control signal occurred, wherein the recent time period is within a specified amount of time of a present time;

using historical positional data relating to the movement of one or more devices with respect to time along the path controlled by the traffic control signal and aggregated over a plurality of occurrences of a given time period to determine cycle time data indicative of a cycle time of the traffic control signal, the given time period including the one or more times at which transitions between phases of the traffic control signal occurred; and using the transition time data and the cycle time data to predict one or more times at which a future transition between phases of the traffic control signal is expected to occur.

2. The method of claim 1 wherein the transition is a transition between a stop phase and a go phase of the traffic control signal.

3. The method of claim 2 wherein the traffic control signal is a traffic light, and the transition is a transition between a red light and a green light.

4. The method of claim 1 comprising, for the or each given transition time that is determined using the live positional data, using positional data relating to one or more devices to determine, for the or each device, data indicative of a time at which the device passed through the traffic control signal and data indicative of a position at which the device began to accelerate away from a waiting state to pass through the traffic control signal, and using the determined data to determine data indicative of the given time at which a transition of the traffic control signal occurred.

5. The method of claim 4 comprising determining data indicative of a distance of the device from the location of the traffic control signal at the position at which the device began to accelerate away from the waiting state, and using the distance together with the data indicative of a time at which the device passed through the traffic control signal to determine the data indicative of a time at which a transition of the traffic control signal occurred.

6. The method of claim 1 wherein the method further comprises using the determined transition time data along with the historical positional data to determine data indicative of the cycle time of the traffic control signal.

7. The method of claim 6 wherein the step of determining the cycle time further comprises:

analysing one or both of the historical positional data and the positional data to identify a plurality of devices having at least one standstill period during movement along the path and to determine, for each of the plurality of devices, data indicative of a time at which the at least one standstill period occurred; and using the determined data indicative of a time at which the at least one standstill period occurred to determine an approximate cycle time or range of cycle times of the traffic control signal.

8. The method of claim 7 further comprising using the determined transition time data and the approximate cycle time or range of cycle times to provide a refined determination of the cycle time.

9. The method of claim 6 comprising using the positional data and the historical positional data to determine a plurality of times at which a transition between phases of the traffic control signal occurred, and wherein the step of determining a cycle time of the traffic control signal comprises determining a time difference between different pairs of past transition times, and determining the cycle time using each time difference.

10. The method of claim 1 further comprising using the or each predicted transition time to carry out one or more of:

providing a speed recommendation to a driver or ADAS;

providing information regarding an expected waiting time at a signal; and determining an estimated travel time along a path involving passing though the traffic control signal.

11. The method of claim 1 further comprising providing a prediction of a future transition time, or information based on such a prediction, to a navigation device or ADAS.

12. A system for determining information relating to the operation of a traffic control signal, the system comprising at least one processor configured to:

use live vehicle probe data comprising positional data relating to the movement of one or more device with respect to time in a recent time period along a path controlled by the traffic control signal to determine transition time data indicative of one or more time at which a transition between phases of the traffic control signal occurred, wherein the recent time period is within a specified amount of time of a present time;

use historical positional data relating to the movement of one or more devices with respect to time along the path controlled by the traffic control signal and aggregated over a plurality of occurrences of a given time period to determine cycle time data indicative of a cycle time of the traffic control signal, the given time period including the one or more times at which transitions between phases of the traffic control signal occurred; and use the determined transition time data and the cycle time data to predict one or more time at which a future transition between phases of the traffic control signal is expected to occur.

13. A non-transitory computer readable medium comprising computer readable instructions that, when executed on a computer, cause the computer to perform a method for determining information relating to the operation of a traffic control signal, the method comprising:

using live vehicle probe data comprising positional data relating to the movement of one or more devices with respect to time in a recent time period along a path controlled by the traffic control signal to determine transition time data indicative of one or more times at which a transition between phases of the traffic control signal occurred, wherein the recent time period is within a specified amount of time of a present time;

using historical positional data relating to the movement of one or more devices with respect to time along the path controlled by the traffic control signal and aggregated over a plurality of occurrences of a given time period to determine cycle time data indicative of a cycle time of the traffic control signal, the given time period including the one or more times at which transitions between phases of the traffic control signal occurred; and using the transition time data and the cycle time data to predict one or more times at which a future transition between phases of the traffic control signal is expected to occur.

14. The system of claim 12, wherein the live positional data is used to determine a time at which a device of the one or more devices passed through the traffic control signal; and a point at which the device began to accelerate away from a waiting state to pass through the traffic control signal.

15. The system of claim 12, wherein the at least one processor is further configured to use the or each predicted transition time to carry out one or more of: providing a speed recommendation to a driver or ADAS; providing information regarding an expected waiting time at a signal; and determining an estimated travel time along a path involving passing though the traffic control signal.

* * * * *